United States Patent [19]

Strawson et al.

[11] 4,160,633

[45] Jul. 10, 1979

[54] APPARATUS FOR MOULDING COMPONENTS IN COMPACTABLE MATERIALS

[75] Inventors: Kenneth H. Strawson; Gerald Spencer, both of Sheffield, England

[73] Assignee: National Research Development Corporation, London, England

[21] Appl. No.: 911,155

[22] Filed: May 31, 1978

[30] Foreign Application Priority Data

Jun. 15, 1977 [GB] United Kingdom ..... 25137/77

[51] Int. Cl.[2] ..... B30B 4/28

[52] U.S. Cl. ..... 425/85; 425/3; 425/84; 425/574; 425/575

[58] Field of Search ..... 425/3, 84, 85, 86, 574, 425/575

[56] References Cited

U.S. PATENT DOCUMENTS

| | | | |
|---|---|---|---|
| 3,019,505 | 2/1962 | Van Den Berge et al. | 425/84 |
| 3,085,291 | 4/1963 | Haes et al. | 425/3 |
| 3,234,598 | 2/1966 | Quinn | 425/3 |
| 3,585,691 | 6/1971 | Wingblade et al. | 425/84 |
| 3,602,287 | 8/1971 | Eversdyk | 425/86 X |
| 3,804,576 | 4/1974 | Hehl | 425/575 X |
| 3,881,853 | 5/1975 | Loubie | 425/3 X |
| 3,989,581 | 11/1976 | Kober et al. | 425/84 X |

*Primary Examiner*—J. Howard Flint, Jr.

[57] ABSTRACT

Apparatus for moulding components in compactable materials, including a die plate with die cavities closed by a filter assembly at one side of the die plate, the filter assembly being constituted by a filter block with a grooved or perforated surface and a filter pad in abutment with said grooved or perforated surface. The compactable material may be a slurry material containing magnetic particles for producing permanent magnet compacts, in which case means may be provided for maintaining a magnetic field around the die cavities.

9 Claims, 8 Drawing Figures

54

Figure 1:
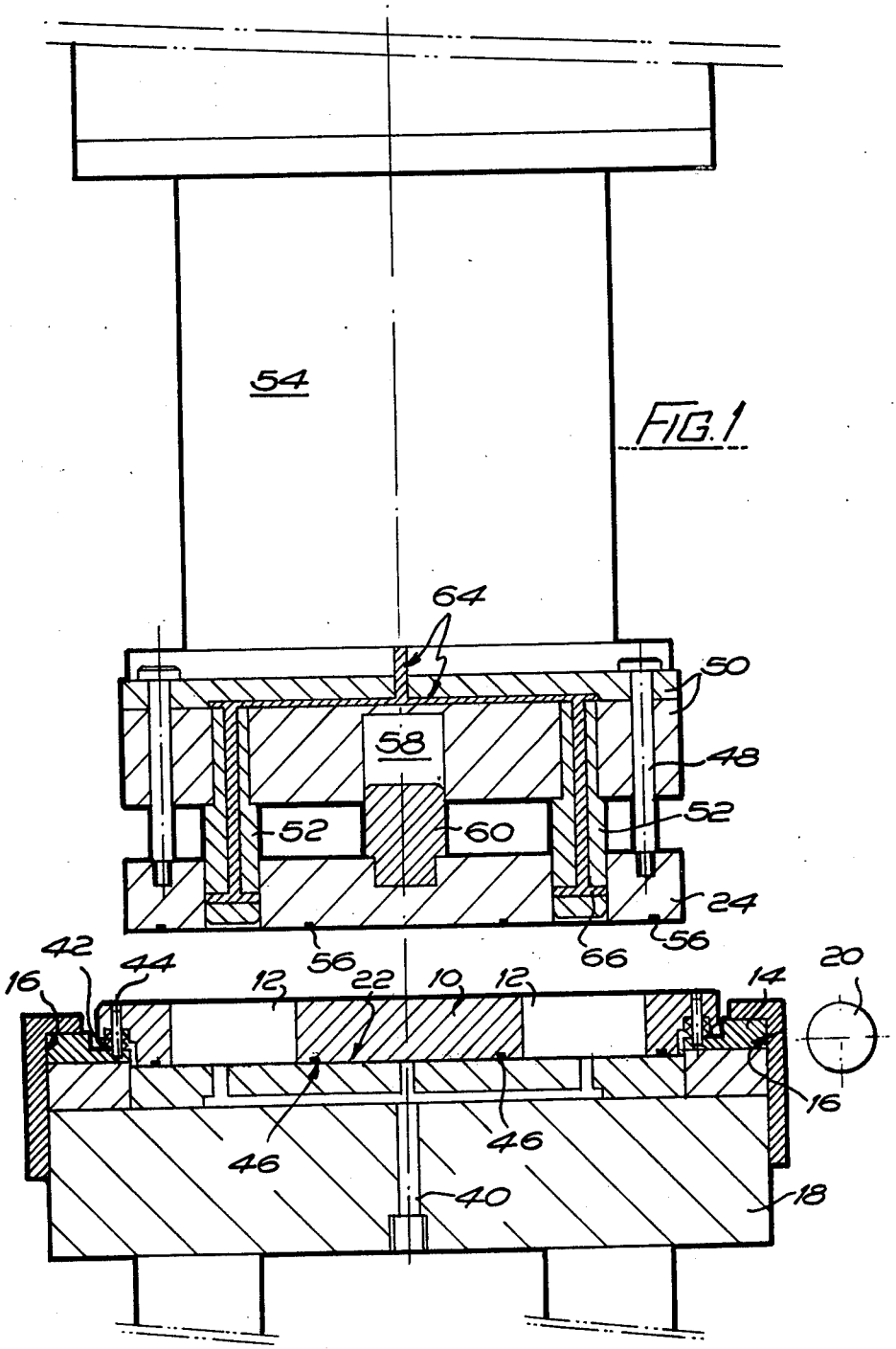

64
50
58
48
52
60
52
24
56
66
56
42
44
16
12
22
10
12
14
20
16
46
46
40
18

54
24
12
10
12

54
48
50
24
56
52
10
12
202
8
8
200
40
18
208
206
204
210
212
213
10
202
214
200

APPARATUS FOR MOULDING COMPONENTS IN COMPACTABLE MATERIALS

The invention relates to apparatus for moulding components in compactable materials. In particular, the invention relates to apparatus including means for injecting a slurry material into a mould cavity from which excess water (or other liquid used in the preparation of the slurry material) can escape through a filter, and means for maintaining a slurry pressure within the mould cavity sufficient to achieve a required density of finished compact. In such apparatus for producing compacts from which permanent magnets are to be produced, the apparatus may also include means for maintaining a magnetic field around the mould so that particles of magnetic material are correctly orientated whilst still suspended in the slurry.

The primary object of the invention is to provide apparatus as described above by means of which compacts of material can be produced at very high rates of production and at relatively low unit cost.

According to the invention, there is provided apparatus for moulding components in compactable materials, the apparatus including a die plate having at least one cavity and a filter assembly adapted to form a closure member for said at least one cavity at one side of said die plate, the filter assembly being constituted by a filter block with a grooved or perforated surface and a filter pad in abutment with said grooved or perforated surface. The filter block may have closely spaced grooves extending both longitudinally and transversely across it so that the filter pad is supported on a plurality of discrete elements. A fluid flow passage may communicate with the grooves or perforations in the surface of the filter block, said flow passage being connected to a vacuum pump by means of which liquid can be sucked from the grooves of the filter block and the cavity or cavities of the die plate.

The filter pad may be a single sheet covering substantially the whole of the filter block. On the other hand, the filter pad may be constituted by a pervious pad element smaller than the filter block or by a number of such pervious pad elements, the remainder of the grooved or perforated area of the filter block being covered by a flat impervious sheet of material. In either of these cases, the filter pad or the or each pad element may be constituted by a sheet of Titanium or of "Formica" (Registered Trade Mark).

Alternatively, the filter pad may be constituted by a short length of material drawn from a roll of flexible filter membrane material. In this case, the roll or flexible filter membrane material may be located at one side of the die plate, means being provided at the other side of the die plate for bringing about intermittent feed of the filter membrane material during the operation of the apparatus. Idler rollers may be provided on opposite sides of the die plate for guiding the material through the gap beneath the die plate when the die plate has moved away from the filter assembly, and means will preferably be provided for maintaining a required tension in the filter membrane material.

Figure 2:
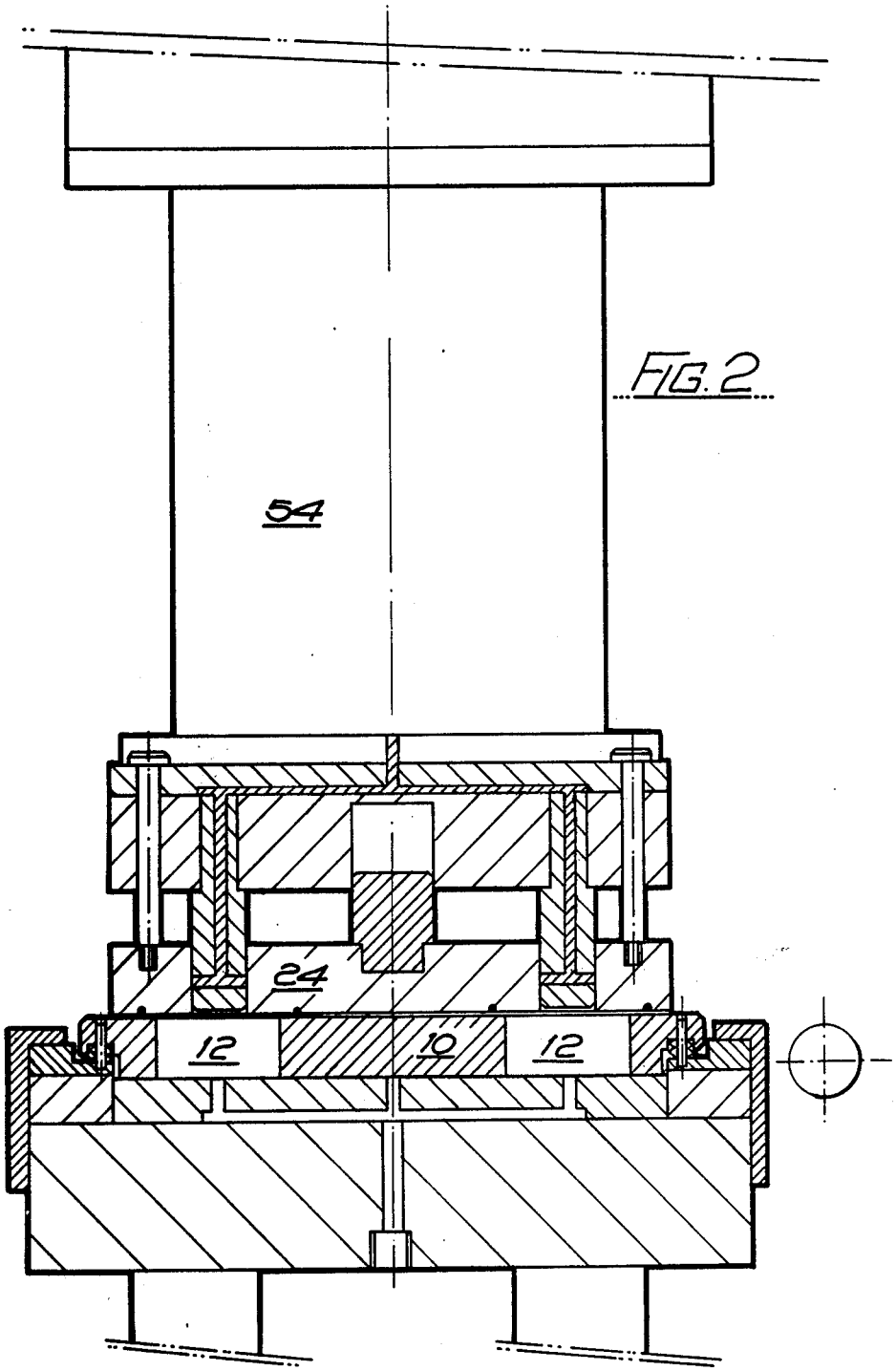
Figure 3:
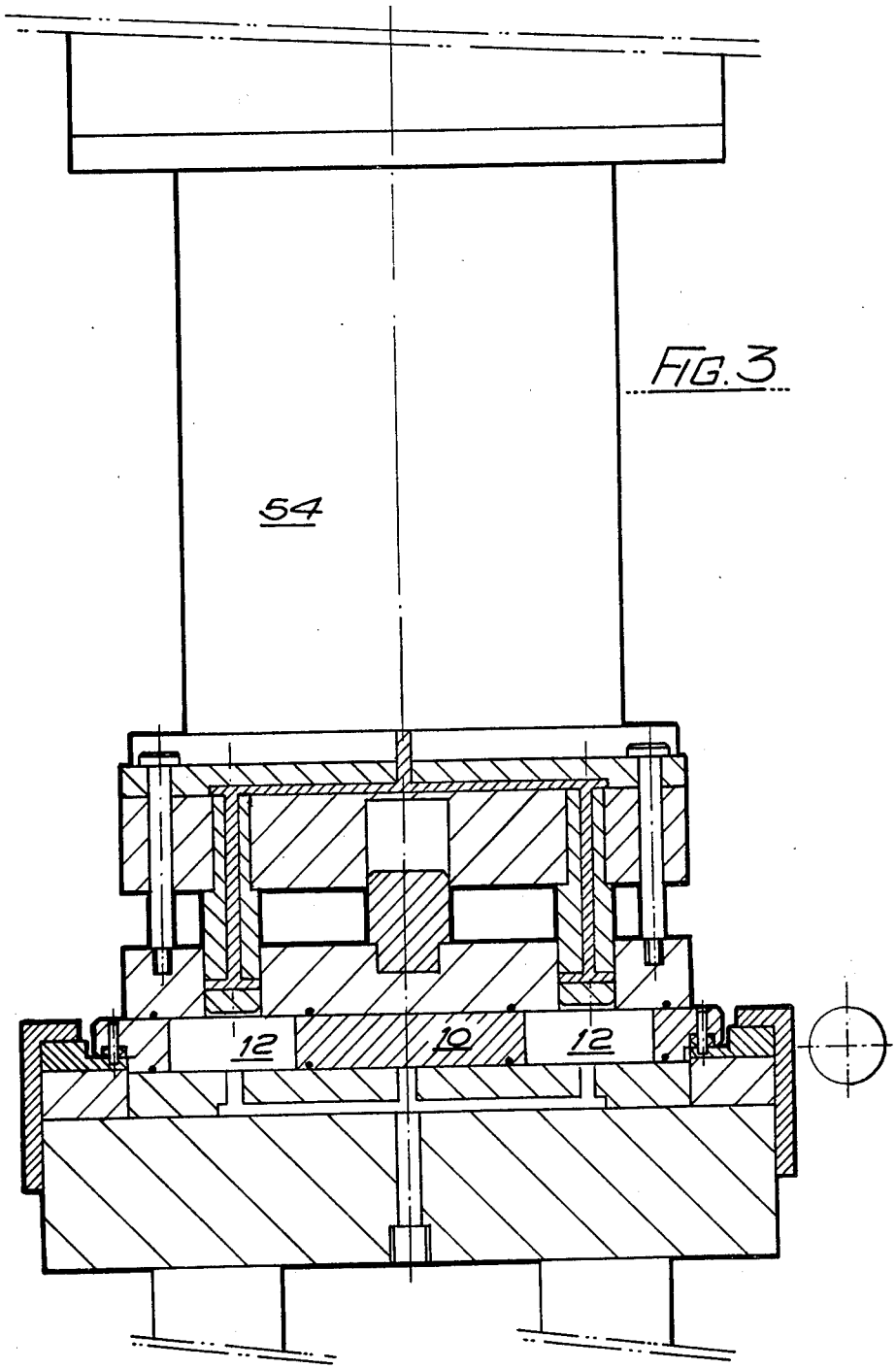
Figure 4:
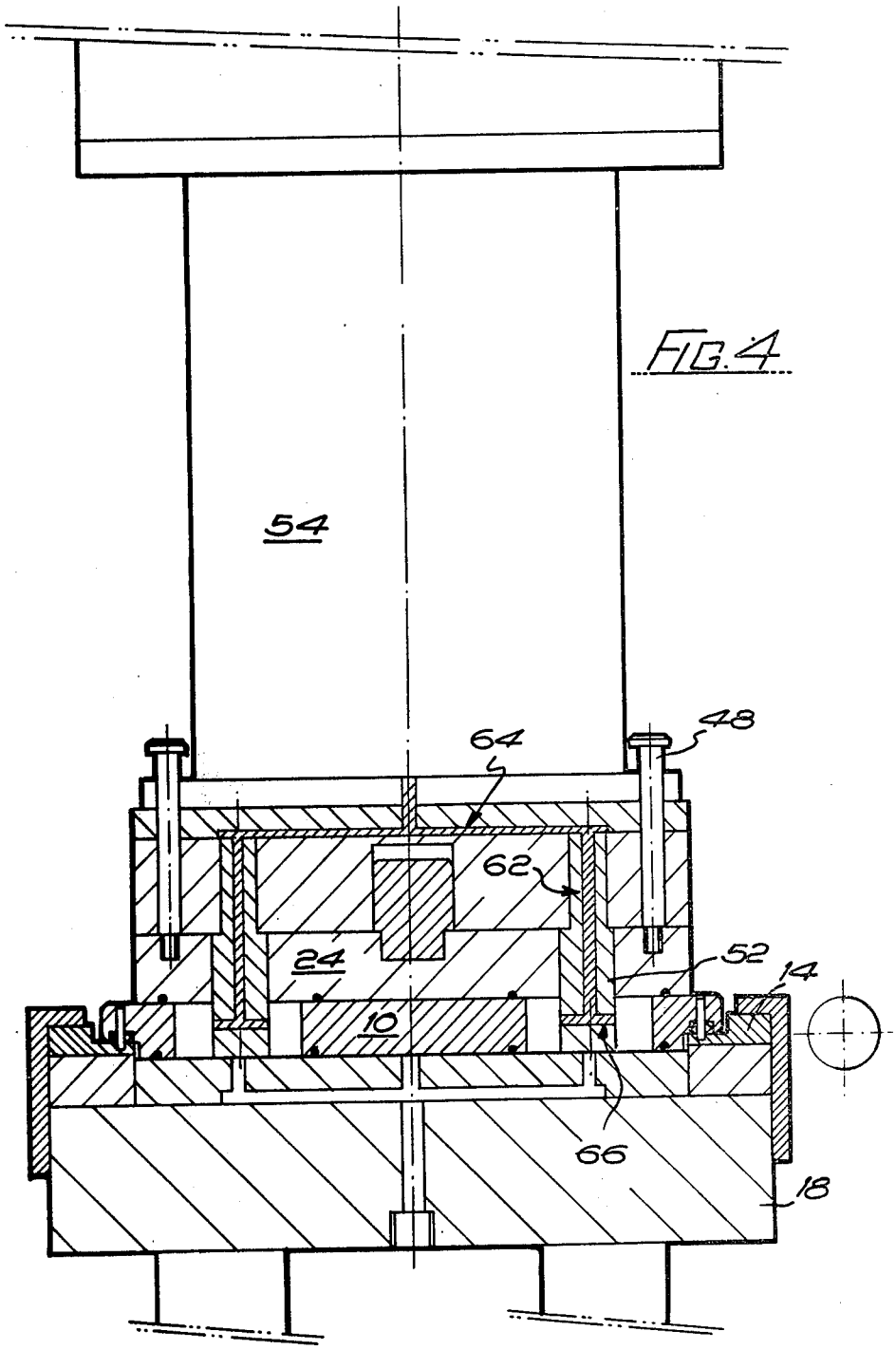
Figure 5:
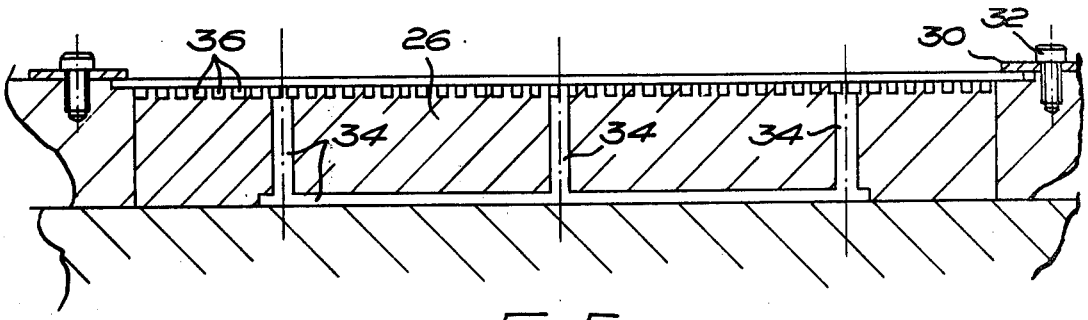
Figure 6:
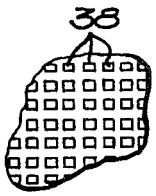
Figures 7, 8:
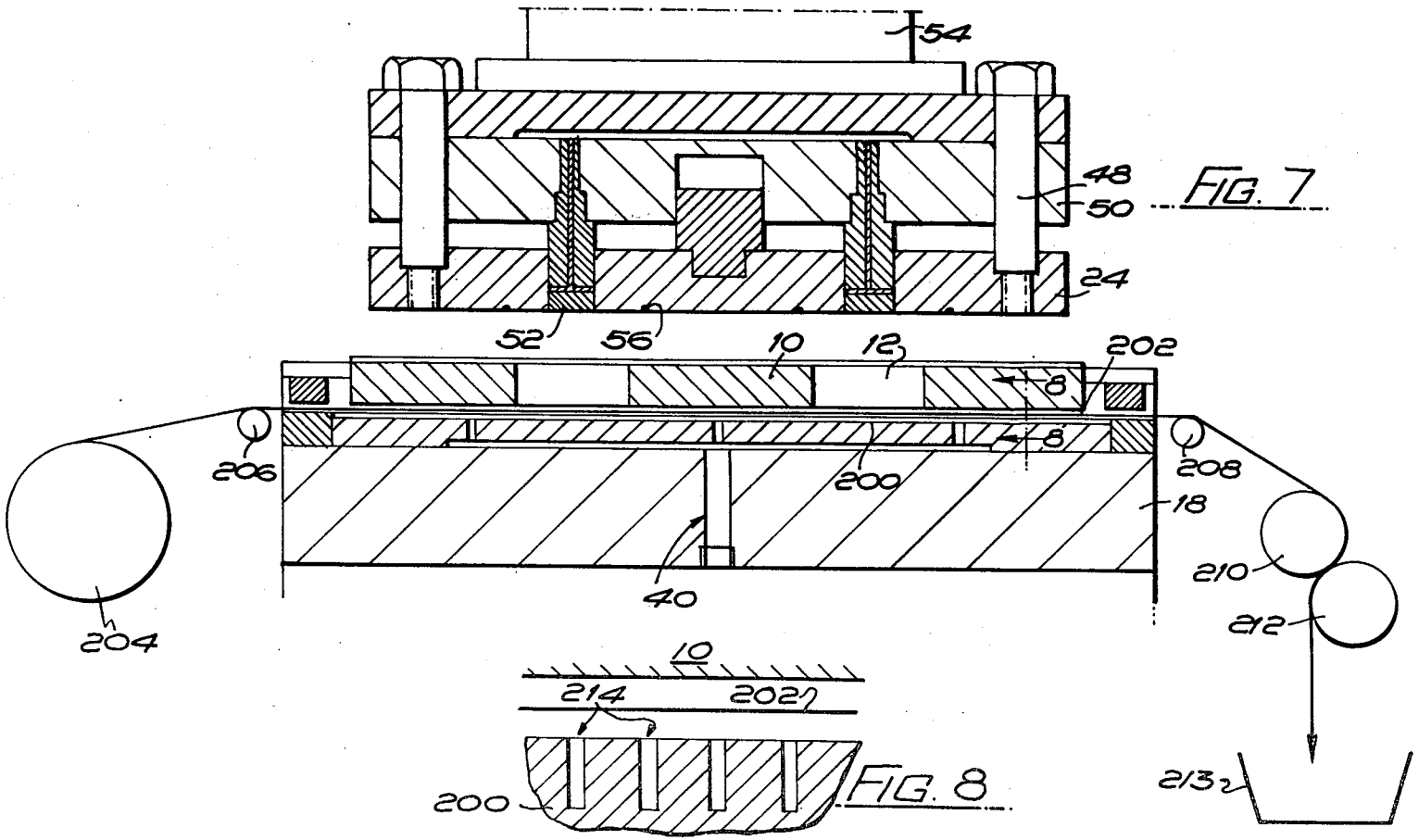

In order that the invention may be fully understood and readily carried into effect, the same will now be described, by way of example only, with reference to the accompanying drawings, of which:

FIG. 1 is a semi-diagrammatic drawing which illustrates the construction of a machine embodying the invention for the production of permanent magnet compacts in a magnetic slurry material, the machine being shown in open condition, FIGS. 2 to 4 illustrate successive stages in the forming of a number of moulded components during the operation of the machine, FIG. 5 is a sectional scrap view of a so-called filter block assembly which will presently be referred to, FIG. 6 is a further scrap view of a part of the filter block assembly, FIG. 7 is a view similar to FIG. 1 which illustrates a modification which will presently be referred to, and FIG. 8 is a scrap sectional view on the line 8—8 in FIG. 7.

Referring now to FIG. 1, the machine there illustrated includes a die plate 10 which is provided with a number of cavities 12 (two such cavities being shown in the drawing) in which respective moulded components are to be formed. The die plate is mounted on a die plate carriage 14 which is slidably mounted in guides 16 on a fixed part 18 of the machine. A hydraulic ram, indicated schematically at 20, is provided for moving the die plate and die plate carriage to and from the position in which they are shown in the drawing, that is to say in which the die plate overlies a filter block assembly, generally indicated 22, and is located beneath a die cover plate 24.

Referring now in particular to FIGS. 5 and 6, the filter block assembly 22 includes a filter block 26 which generally corresponds in size and shape to the outline shape of the die plate. The filter block is attached to the frame part and a filter pad 28 of rectangular outline shape overlies the filter block. The filter pad is constituted by a sheet of pervious material and is held in place by a number of clamp elements 30 and screws 32. A series of closely spaced grooves 36 extend longitudinally and transversely across the top face of the filter block and communicate with fluid flow channels 34. As shown in FIG. 6, the filter pad is thus supported on a plurality of discrete elements 38. A fluid flow passage 40 is shown in FIG. 1 to open from the fluid flow channels 34 of the filter block and this may be connected to a vacuum pump (not shown) by means of which, at a certain stage in the operation of the machine, liquid can be sucked from the fluid flow channels and cavities of the die plate, through the filter and through the filter block.

It will be seen in FIG. 1 that the die plate, at the initial stage of operation of the machine is suspended above the filter block assembly on stacks of Belleville spring washers 42 which are located on guide rods 44 upstanding from the die plate carriage. The die plate is located in position by, but slidable vertically on, the guide rods. The underside of the die plate is provided with resilient sealing elements 46 which surround the respective cavities 12, and when the die plate is downwardly displaced the sealing elements are pressed against the filter pad 28.

The die cover plate 24 is suspended on a plurality of headed guide pins 48 which extend slidably through a core plate/gallery plate assembly 50, and respective core rods 52 which are to extend through the cavities 12 of the die plate are connected to the core plate and extend slidably through bores in the die cover plate. The core plate is carried, for vertical movement, by a hydraulic ram assembly, generally indicated 54. Resilient sealing elements 56 are provided at the underside of the die cover plate and surround the bores through which the core rods extend, the arrangement being such that, as shown in FIG. 2, the sealing elements contact the top surface of the die plate when the hydraulic ram assembly is extended and the die cover plate is lowered onto the die plate, the upper ends of the cavities 12 being sealed thereby. Further downward movement of the core plate/gallery plate assembly causes the die plate to be pressed downwardly against the filter block assembly as shown in FIG. 3, and a still further downward movement of the core plate/gallery plate assembly causes the core rods to extend through the die cover plate and to abut against the filter pad 28 as shown in FIG. 4.

Means are provided whereby the core plate and die cover plate can be urged apart to the maximum extent permitted by the guide pins 48 as shown in FIG. 1, said means being constituted by a centrally disposed cylinder 58 which is formed in the core plate and which accommodates a piston 60 in contact with the die cover plate, the arrangement being such that when a hydraulic pressure is ducted to said cylinder the die cover plate is urged downwardly with a controlled and constant pressure. Consequently, when the core plate/gallery plate assembly is subsequently to be raised to its initial position it can be arranged that the core rods will be retracted from the cavities 12 of the die plate before the die cover plate is raised. Consequently, the moulded components which have been formed in the cavities 12 by the application of hydrostatic pressure to the slurry in the cavities to achieve a required density and shape of the finished compacts, and which are still relatively fragile at this stage, are retained in the cavities until the core rods have been extracted.

Means which are provided for ducting a compactable slurry material to the cavities 12 of the die plate when the die has been closed include feed passages 62 which extend through the core rods from a common feed gallery 64 and which communicate with respective cross ports 66 near the ends of said core rods. The arrangement is such that when the core rods have been retracted into the die cover plate, as shown in FIG. 1, the ends of the cross ports are sealed, but when said core rods have been extended through the cavities in the die plate as shown in FIG. 4 they open into said cavities for the supply of the slurry material thereto. A slurry pressure can be maintained in the die cavities by means (not shown) associated with the hydraulic ram assembly 54, for a predetermined period of time following their filling by the slurry material so that liquid is expelled through the filter assembly to produce compacts of material in the respective cavities in a required compacted condition. When the required condition of the compacts has been achieved, the material in at least the portions of the slurry feed passages nearest the cavities may be in that same compacted condition but this is of no importance because these plugs of material will be injected into the die cavities during the next moulding operation and will immediately form a homogenous mass with the slurry material entering the cavities behind them.

Means (not shown) are provided for maintaining a magnetic field around the material in the die cavities as the slurry pressure is maintained and in this way the particles of magnetic material are correctly orientated whilst still suspended in the slurry before and during the compacting process.

The production of moulded components in a compactable material in the manner described above is advantageous in a number of respects. For example, when the filter pad becomes blocked to such an extent that the slurry in the or each die cavity cannot be quickly compacted it can very easily be replaced by a new one. That is to say, with the die plate laterally displaced from the position in which it is shown in FIGS. 1 to 4, access can be had to the screws 32 and clamp elements 30 which when slackened and swivelled clear of the edges of the filter pad allow the latter to be removed from the filter block for replacement by a new one. Furthermore, if the filter pad is made of a Titanium sheet, or a similar acid resistant pervious material, a blocked filter pad can be cleaned by pickling in acid. On the other hand, the filter pad may be a relatively low cost replaceable element made from a material such as "Formica."

The die plate can of course very easily be changed if a different size or shape of compact is to be produced (and of course the core plate, core rods and die cover plate are also interchangeable). With some die plate configurations it may be found that only a relatively small part of the filter pad will be utilized if it is made substantially the same overall size and shape as the die plate. In these circumstances a reduced size filter pad, or a plurality of reduced size filter pads, may be used and the remainder of the area of the filter block will then be covered by a flat impervious sheet of material (for example a sheet of mild steel) so that the vacuum conditions can be retained and/or economy of filter pad usage maintained.

Means may be provided to progressively increase the period during which pressure is maintained within the die cavities to compensate for progressively increasing filter pad blockage before such blockage is such as to require a change of filter pad.

In addition to the filter block assembly 22 the machine may be provided with further filter means through which liquid can be squeezed out from the slurry by pressure maintained in the die cavities. Such further filter means could be incorporated in the die cover plate for example. The filter pad 28 (and the filter pad or pads incorporated in such further means) need not necessarily be constituted by a single sheet of pervious material but could be constituted by two or more sheets of different materials assembled together in sandwich form, for example a sandwich construction of wire mesh, nylon and paper.

Referring now to FIGS. 7 and 8, in a further modification the filter assembly previously described is shown to have been replaced by an assembly including only a filter block 200 and a pervious filter membrane 202 extending across the top of the filter block. The filter membrane is provided in the form of a roll 204 of flexible filter membrane material at one side of the die plate, an operative length of which is drawn off from the roll to extend over idler rollers 206 and 208 and to extend as shown between a driven feed roller 210 and a "pinch" roller 212. Used filter membrane material is shown to be falling into a collection bin 213 (but of course it will be understood that it could equally well have been arranged for used filter membrane material to be wound on a drum). The driven feed roller is driven intermittently by means not shown so that intermittent feed of the filter membrane material can be brought about during the operation of the machine, that is to say, for example, between successive moulding operations when the die cover plate is in raised condition as shown in the drawing. The idler rollers are positioned as shown so that the membrane material is guided through the gap between the die plate and the filter block, when such intermittent feed of the membrane material takes place, the efficient operation of the feed mechanism being unaffected by the fact that the diameter of the roll 204 is reduced as it becomes depleted. Means (not shown) are provided for impeding the free rotation of the roll 204, that is to say for applying a very small braking force to the roll, so that a required tension is maintained in the filter membrane, the arrangement being such that such means are self-compensating to allow for the gradual reduction in the inertia of the roll of membrane material as it become depleted. The means (not shown) for mounting the roll of membrane material are such as to facilitate its replacement when depleted.

Referring to FIG. 8, which is drawn to a very much enlarged scale, it will be seen that closely spaced grooves 214 which extend across the top face of the filter block (and which communicate with the fluid flow passage 40 shown in FIG. 7) are of very narrow width in relation to their depth so that the filter block is sufficiently flat and smooth to adequately support the filter membrane whilst facilitating adequate drainage of fluid passing through the filter membrane. (Such relatively deep and narrow and closely spaced grooves can be formed by spark erosion techniques). However, it will be understood that, if preferred, the filter block could have been provided with an overlying filter pad (the filter block and filter pad being substantially like those previously described and illustrated in FIGS. 5 and 6) the previous filter membrane being arranged to overlie the filter pad.

The means (not shown) by which the feed roller 210 is driven intermittently to bring about intermittent feed of the filter membrane material include a rack and pinnion drive mechanism (not shown) arranged to be actuated automatically by the moving of the die plate from its position between the filter assembly and the die cover plate to the position in which the or each compact produced in the die plate can be removed. (It could of course equally well have been arranged to be actuated in response to return movement of the die plate). The drive mechanism is such that the rate at which the filter membrane material is fed from the roll is adjustable, and it will be understood that instead of or in addition to this, the frequency with which the operative length of membrane material is replaced could be adjustable, that is to say so that instead of being replaced after each moulding operation it is replaced after a certain number of moulding operations have been carried out. Various other means could have been provided for bringing about intermittent feed of the filter membrane material. For example, a chain and sprocket drive could have been used or a direct coupled electric motor could have been arranged to stop and start by electrical control signals produced in response to such movements of the die plate. On the other hand, a D.C. torque motor drive system could have been arranged to run almost continuously (the closure of the die assembly causing the filter membrane to be trapped beneath the underside of the die plate so that the motor would at that time assume a temporarily stalled condition).

Various other modifications may be made without departing from the scope of the invention, and it will be understood that the die plate illustrated in the drawings has been shown to have plain cylindrical cavities for the sake of simple illustration. In practice the die plate can be of more complex construction, being made in several parts so that the compacts produced can be of a more complex shape. It will also be understood that the core rods need not be of plain cylindrical shape. Indeed, if the compacts are not required to have a cored form the core rods can be omitted, in which case the feed passages for the compactable material will emerge at the underside of the die cover plate, to inject material directly into the die cavities or to communicate with ports in the die plate which communicate with the die cavities.

Means constituting a pressure intensifier may be associated with the hydraulic ram assembly 54 for feeding the compactable slurry material under pressure to the die cavities. On the other hand, such means could conceivably be constituted by electro magnetic means producing an induction effect within a slurry flow line.

What we claim and desire to secure by Letters Patent is:

1. In apparatus for moulding components in compactable materials, a die plate having at least one die cavity, a filter assembly adapted to form a closure member for said at least one die cavity at one side of said die plate, and means for injecting a slurry material into the at least one die cavity and for maintaining a slurry pressure within the mould cavity sufficient to achieve a required density of finished compact, the filter assembly being constituted by a filter block with a grooved surface and a filter pad in abutment with said grooved surface.

2. Apparatus according to claim 1, in which the filter block has closely spaced grooves extending both longitudinally and transversely across it so that the filter pad is supported on a plurality of discrete elements.

3. Apparatus according to claim 1, in which a fluid flow passage communicates with the grooves in the surface of the filter block, and said flow passage is connected to a vacuum pump by means of which liquid can be sucked from the grooves of the filter block and the at least one cavity of the die plate.

4. Apparatus according to claim 1, in which the filter pad is a single sheet covering substantially the whole of the filter block.

5. Apparatus according to claim 1, in which the filter pad is constituted by at least one pervious pad element smaller than the filter block, the remainder of the grooved area of the filter block being covered by a flat impervious sheet of material.

6. Apparatus according to claim 4, in which the filter pad is constituted by a sheet of Titanium.

7. Apparatus according to claim 1, in which the filter pad is constituted by a short length of material drawn from a roll of flexible filter membrane material.

8. Apparatus according to claim 7, in which the roll of flexible filter membrane material is located at one side of the die plate, means being provided at the other side of the die plate for bringing about intermittent feed of the filter membrane material during the operation of the apparatus.

9. Apparatus according to claim 7, in which means are provided for maintaining a required tension in the filter membrane material.

* * * * *